United States Patent [19]

Yadock

[11] Patent Number: 5,027,966

[45] Date of Patent: Jul. 2, 1991

[54] STORAGE CONTAINERS WITH MAGNETIC HANDLING MEANS

[76] Inventor: David J. Yadock, 625 S. 17th St., Renton, Wash. 98055

[21] Appl. No.: 405,967

[22] Filed: Sep. 12, 1989

[51] Int. Cl.[5] ..... B65D 51/00

[52] U.S. Cl. ..... 220/230

[58] Field of Search ..... 215/228; 220/212, 230

[56] References Cited

U.S. PATENT DOCUMENTS

| | | | |
|---|---|---|---|
| 4,110,552 | 8/1978 | Lombardi | 220/230 X |
| 4,168,129 | 9/1979 | Herrnring | 220/230 X |
| 4,223,799 | 9/1980 | Eyster et al. | 220/230 |
| 4,711,365 | 12/1987 | Fomby | 220/288 |

*Primary Examiner*—Stephen Marcus
*Assistant Examiner*—Nova Stucker

[57] ABSTRACT

A removable cap for use with a test tube or the like has metallic characteristics associated therewith, in order to facilitate the handling of the test tubes in hostile environments. The cap has a recess provided therein which extends from a first surface toward a second surface. A metallic member is positioned in the recess and a second cap member is positioned over the recess, the second cap member cooperating with the recess to maintain the metallic member in position in the recess. The cap is attached to the test tube, so that when a magnetic rod is position over the removable cap, the metallic member is attracted to the magnetic rod, causing the cap and test tube to be moved.

14 Claims, 1 Drawing Sheet

STORAGE CONTAINERS WITH MAGNETIC HANDLING MEANS

FIELD OF THE INVENTION

The invention relates to storage containers which have means provided therein to facilitate the handling of the containers. In particular, the invention is directed to tubes or the like which have magnetic properties which allow for the easy manipulation of the tubes.

BACKGROUND OF THE INVENTION

Various container, such as plastic storage containers which hold biological specimens, are often used in circumstances in which the handling of the containers is difficult due to the surroundings in which they are stored. As an example, cryotubes are placed in liquid nitrogen or in freezers in which temperatures are held at approximately −80 degrees Celsius. The placement of the cryotubes in these environments is required in order to insure that the biological specimens will not be damaged.

Due to the extreme temperatures and other hostile environments in which the containers are stored, the handling of these containers becomes difficult and sometime hazardous for the technician. At present several methods are used which attempt to minimize the risk involved to the technician responsible for handling the containers. One of the common methods utilized for the handling of the containers is for the technician to pick up the container with his/her fingers. However, the constant exposure to the extreme temperatures or liquid nitrogen may cause damage to the nerves in the technician's hand. Also, the direct handling of the container exposes the technician to the possibility of biohazardous contamination. These are unacceptable results.

An alternative method to handle the cryotubes and the like, is with the use of forceps. The forceps are used to engage the tubes, so that the technician is not required to place his fingers in the hostile environment, thereby reducing the risk to the technician. However, in particular situations, such as when the containers are submersed in the liquid nitrogen, the use of forceps is unreliable. When utilizing forceps, the technician must be careful that the condensation of the liquid does not cause the container to slip from the forceps. If the container does slip, the contents of the container will be destroyed.

Consequently, in would prove beneficial to develop a means of handling the containers in which the device utilized to manipulate the tubes is unaffected by the environment in which the containers are positioned. It is important that the means of handling the containers does not interfere with the storage and testing of the substances contained therein. Also, as the space required for storage is expensive, the size of the containers must be minimized. It is also essential that the means required for handling be easily incorporated into the tubes currently in use, without significantly increasing the cost thereof.

SUMMARY OF THE INVENTION

The invention is directed to a container for use in the storage of a substance. The container is configured to facilitate the handling thereof in environments which are not conducive to standard handling means.

The container comprises a storage compartment for storing a substance therein. A closure means is provided on the storage compartment, the closure means cooperates with the storage compartment to seal the substance in the storage compartment. The closure means being releasably engaged with the storage compartment. Magnetic means are provided proximate the closure means and attached thereto, whereby as a magnetic device is positioned over the container, the magnetic device attracts the magnetic means, and therefore, the container.

A method is also disclosed in which a magnetic rod or the like is positioned over a container having a magnetic means provided therein. The magnetic means, and consequently the container, is then magnetically attracted toward the magnetic rod, and placed in engagement therewith. The magnetic rod with the container engaged therewith is then moved from the hostile environment, and the container is removed.

DETAILED DESCRIPTION OF THE INVENTION

Figure 1:
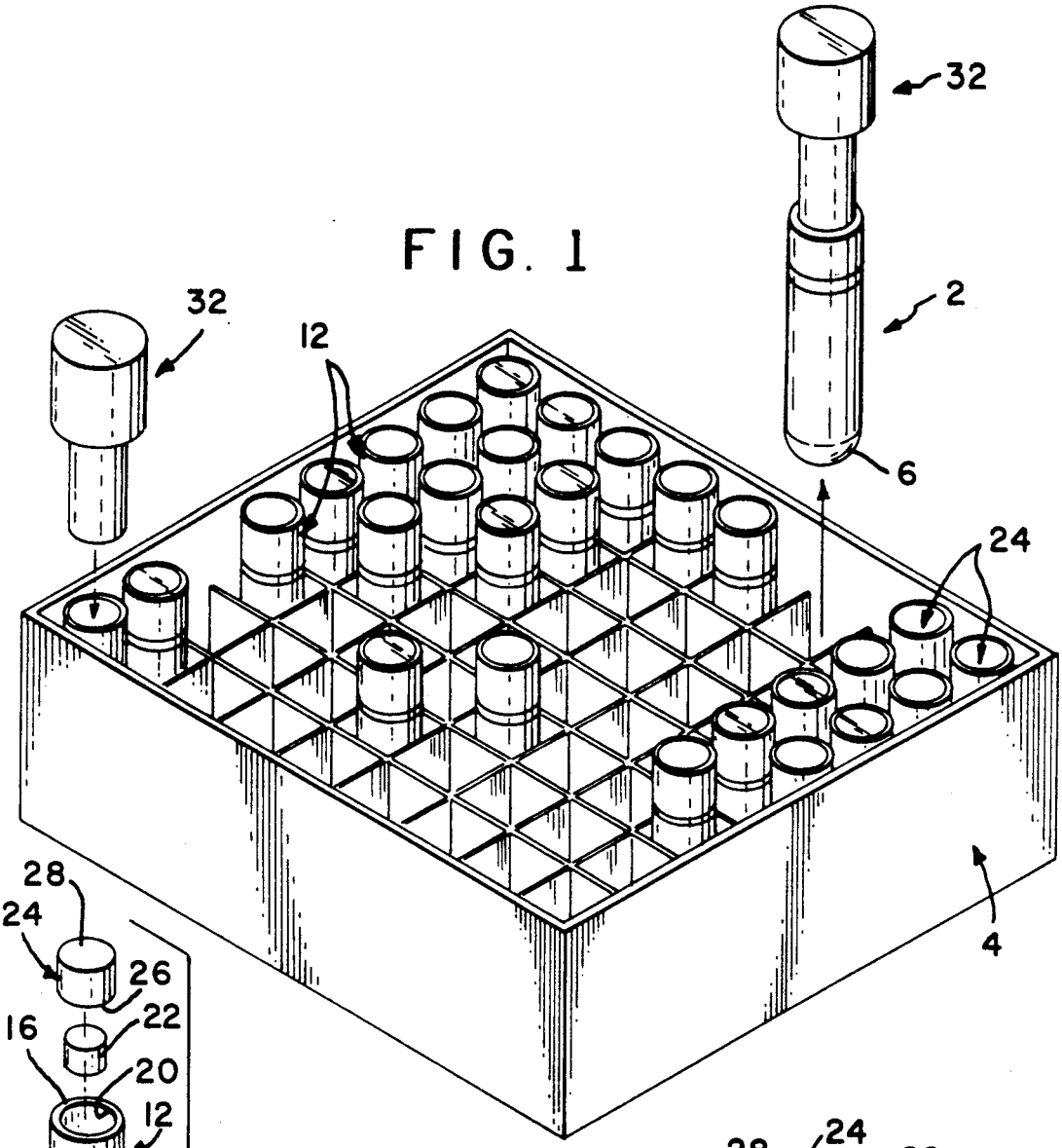
FIG. 1 is a perspective view of a plurality of test tubes or the like positioned in a storage container, a magnetic rod is shown in various positions relative to the storage container, the magnetic rod cooperating with the test tubes to remove the test tubes from the container.

As shown in FIG. 1, cryotubes 2 are stored in storage containers 4. Storage containers 4 are made from cardboard, metal or any other material which is suitable. The storage containers 4 are configured in such a manner to hold as many cryotubes as possible in a minimal amount of space. This is necessitated due to the fact that the freezers and liquid nitrogen in which the containers are placed are expensive. Consequently, the cryotubes must be densely packed in order to minimize the amount of space required for storage.

Cryotubes 2 are manufactured from plastic, or any other material capable of withstanding the temperature ranges which the container are subjected. Cryotubes are containers used to hold biological specimens. These specimens must be stored in liquid nitrogen or freezers which are capable of reaching −80 degrees Celsius. Although cryotubes are shown and described, it is worth noting that any type of test tube or the like may be used.

Figure 2:
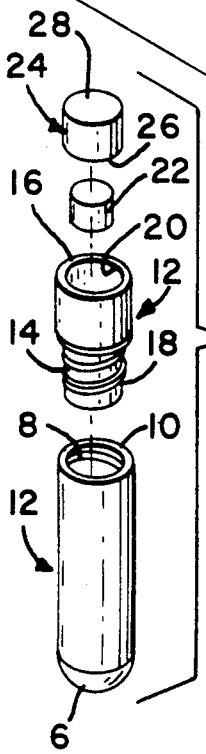
FIG. 2 is a perspective view of a respective test tube with a cap exploded therefrom.

As best shown in FIG. 2, cryotubes 2 have a generally cylindrical or tubular shape, with a closed end 6 and an open end 8. The cryotubes have the same general configuration as general test tubes. Open end 8 has threads 10 provided proximate thereto. The threads can be provided on the inside diameter of the outside diameter of tube 2, depending on the particular application. In the embodiment shown the threads 10 are provided on the inside diameter.

Vial cap 12 has a tubular configuration with a closed end 14 and an oppositely facing open end 16. Closed end 14 has threads 18 provided proximate thereto. In the embodiment shown, threads 18 are provided on the outside diameter of cap 12. Cap 12 is secured to cryotube 2 by the cooperation of threads 10 and 18. This provides the seal required between the cap 12 and tube 2, thereby insuring that a substance provided in the cryotube will be maintained therein.

Opening 20 extends from open end 16 toward closed end 14. Member 22 is provided in opening 20. The dimensions of member 22 are essentially identical to but slightly smaller than the corresponding dimensions of opening 20. This insures that member 22 can be easily inserted into the opening 20 and accurately positioned therein. Member 22 is made from metal or any other material having the metallic characteristics required. In the alternative, the cap may be manufactured from metal or the like, thereby eliminating the need for member 22.

Figure 3:
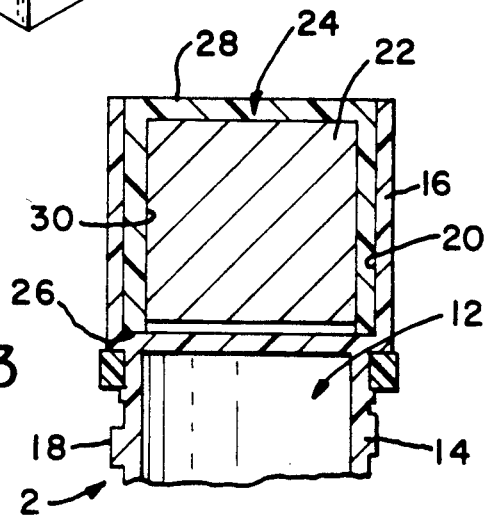
FIG. 3 is a cross-sectional view of the cap of the invention, showing the positioning of a magnetic member therein.

A cap 24, shown in FIGS. 3 and 3, is positioned in opening 20 through open end 16 of vial cap 12. As best shown in FIG. 3, cap 24 has a first end 26 and a second end 28. An opening 30 extends from first end 26 toward second end 28. The cap 24 is color coded to indicate the substance which is placed in the cryotube.

Cap 24 is positioned in opening 20, as best shown in FIG. 3. The cooperation of cap 24 with opening 20 provides a frictional engagement therebetween which secures cap 24 in opening 20. As is shown in FIG. 3, opening 20 and opening 30 cooperate to provide an enclosed recess in which member 22 is positioned.

The configuration of the tubes 2 and the caps 12 can vary according to the requirements of the system. As an example, the cap 24 may be made of metal, thereby eliminating the need for member 22. As there are many various possibilities, an explanation of each will not be provided.

With tube 2, cap 12, cap 24, and member 22 assembled together, tubes 2 are placed in storage container 4. As was previously discussed, tubes 2 are closely spaced together in storage container 4. This close spacing makes is difficult to remove the tubes from the container, as little space is provided for bulky handling devices to be inserted between the tubes.

In order to remove the tubes from the container, a magnetic rod 34 or similar means, i.e. electromagnetic rod, is used. As shown in FIG. 1, the magnetic rod 32 is positioned above the desired cryotube 2 and moved proximate the second end 28 of cap 24. The magnetic rod 32 cooperates with the metallic member 22 to attract the metallic member 22 toward the magnetic rod 32. As the cap 24 is frictionally maintained in cap 12, the magnetic attraction of the metallic member 22 toward magnetic rod 32 causes the entire cryotube assembly to be moved toward magnetic rod 32. The magnetic rod is then retracted, thereby removing the cryotube from the storage container 4.

Once the tube is removed from the storage container, the technician can remove the tube from the rod by merely pulling the tube with sufficient force to overcome the magnetic attraction between the member 22 and the rod 34. It is worth noting that if a electromagnetic rod is used, the technician would not have to remove the tube with his/her hands. Rather, the tube would be moved to the desired position, and the power to the electromagnetic rod would be switched off, thereby causing the tube to disengage from the rod. Utilizing the rod 34 to remove the tube 2 from the container 34 provides several advantages.

A first advantage relates to spacing. The magnetic rod cooperates with the second end 28 of the cap 24 when the tube is removed from the container. Consequently, no space is required between the tubes for such things as forceps or fingers. Therefore, the spacing between the tubes can be minimized.

A second advantage relates to the reliability of handling. As discussed previously, problems are associated with the devices currently used to handle the cryotubes, i.e. forceps do not work well when the tubes are submersed in a liquid. Consequently, if the tubes slip from the technicians fingers or from the forceps, the tube is usually dropped to the bottom of the freezer, and lost in the pool of liquid nitrogen that creates the vapor phase storage system. Utilizing the handling method of the present invention eliminates these problems. In the first place, there is little chance of the tube being dropped and damaged. Even if the tube is dropped into the pool of liquid nitrogen, the tube can be retrieved by means of the present invention. In order to facilitate this retrieval, a longer rod may be utilized. Consequently, the reliability of the handling is increased.

Utilizing the magnetic rod as described above eliminates the need for the technician to directly engage the tubes, when the tubes are provided in the hostile environment. This reduces the risk to the technician. This is particularly advantageous when hazardous material, i.e. radioactive material, is provided in the tubes.

Changes in construction will occur to those skilled in the art and various apparently different modifications and embodiments may be made without departing from the scope of the invention. The matter set forth in the foregoing description and accompanying drawings is offered by way of illustration only.

I claim:

1. A container for use in the storage of a substance, the container comprising:

a storage compartment for storing a substance therein;

a closure means provided on the storage compartment, the closure means cooperate with the storage compartment to seal the substance in the storage compartment, the closure means is a cap which is positioned at an open end of the storage compartment, the cap and the storage compartment have threads which cooperate with each other to provide the means to attach the cap to the storage compartment;

magnetic means provided proximate the closure means and attached thereto, the magnetic means fixedly mounted in the closure means, such that the magnetic means does not move relative to the closure means;

whereby as a magnetic device is positioned over the container, the magnetic device attracts the magnetic means, and the container.

2. A container as recited in claim 1 wherein the cap has a first end and a second end, the first end having the threads provided thereon, and the second end having a recess which extends from the second end toward the first end.

3. A container as recited in claim 2 wherein the cap has a member provided in the recess thereof, the member has magnetic characteristics associated therewith.

4. A container as recited in claim 3 wherein a top cap is positioned in the recess, the top cap having dimensions approximately equal to the dimensions of the recess, such that as the top cap is inserted into the recess, the top cap will frictionally engage the surfaces of the recess to maintain the top cap in the recess and thereby insure that the member is maintained in the recess.

5. A container as recited in claim 4 wherein the member is made from metallic material.

6. A removable cap for use with a storage container, the cap comprising:

a top surface, a bottom surface, and a side surface which extends from the top surface to the bottom surface;

an opening which extends from proximate the top surface to proximate the bottom surface;

magnetic means provided in the opening;

a sealing means positioned in the opening, the sealing means cooperate with the opening to maintain the magnetic means therein, fixedly mounting the magnetic means in the removal cap;

retention means provided on the cap, the retention means cooperate with the storage container to retain the cap on the storage container, the retention means having threads which cooperate with the storage container;

whereby as a magnet is placed in the proximity of the cap, the magnetic means will cooperate with the magnet to move the cap between a first position and a second position, as the magnet is moved between the first position and the second position.

7. A cap as recited in claim 6 wherein the storage container is a tube with a closed end and an open end.

8. A cap as recited in claim 6 wherein the opening of the cap extends from the top surface toward the bottom surface.

9. A cap as recited in claim 8 wherein the sealing means is a second cap which has dimensions approximately equal to the dimensions of the opening, such that as the second cap is inserted into the opening, the second cap will frictionally engage the surfaces of the opening to maintain the second cap in the opening and thereby insuring that the metallic means is maintained in the opening.

10. A container as recited in claim 6 wherein the magnetic means is made from metallic material.

11. A container for use in the storage of a substance, the container comprising:

a storage compartment for storing a substance therein, the storage compartment is a tube with a closed end and an open end;

a closure means provided on the storage compartment, the closure means cooperate with the storage compartment to seal the substance in the storage compartment, the closure means is a cap which is positioned at an open end of the storage compartment, the cap and the storage compartment have threads which cooperate with each other to provide the means to attach the cap to the storage compartment;

magnetic means provided proximate the closure means and attached thereto, the magnetic means fixedly mounted in the closure means, such that the magnetic means does not move relative to the closure means;

whereby as a magnetic device is positioned over the container, the magnetic device attracts the magnetic means, and therefore, the container.

12. A container as recited in claim 11 wherein the cap has a first end and a second end, the first end having the threads provided thereon, and the second end having a recess which extends from the second end toward the first end.

13. A container as recited in claim 12 wherein the magnetic means is provided in the recess of the cap.

14. A container as recited in claim 13 wherein a top cap is positioned in the recess, the top cap having dimensions approximately equal to the dimensions of the recess, such that as the top cap is inserted into the recess, the top cap will frictionally engage the surfaces of the recess to maintain the top cap in the recess and thereby insure that the magnetic means is maintained in the recess.

* * * * *